US005696802A

United States Patent [19]

Hafezan

[11] Patent Number: 5,696,802

[45] Date of Patent: Dec. 9, 1997

[54] SHEET COUNTER HEAD CONTROL

[75] Inventor: Siavosh Hafezan, Colchester, United Kingdom

[73] Assignee: Pelcombe Limited, United Kingdom

[21] Appl. No.: 569,112

[22] PCT Filed: Jun. 16, 1994

[86] PCT No.: PCT/GB94/01303

§ 371 Date: Dec. 18, 1995

§ 102(e) Date: Dec. 18, 1995

[87] PCT Pub. No.: WO95/00927

PCT Pub. Date: Jan. 5, 1995

[30] Foreign Application Priority Data

Jun. 18, 1993 [GB] United Kingdom ..... 9312613

[51] Int. Cl.[6] ..... G06M 7/00

[52] U.S. Cl. ..... 377/8

[58] Field of Search ..... 377/8

*Primary Examiner*—Margaret Rose Wambach

*Attorney, Agent, or Firm*—Andrus, Sceales, Starke & Sawall

[57] ABSTRACT

A counter for counting the number of sheets in a stack has a rotor (12) which engages in an edge region of the stack and transfers sheets one at a time from one side of the rotor to the other upon rotor rotation. The rotor (12) is mounted on a shaft (13) carried by a carriage (36) arranged for sliding movement on guides (41). A motor (44) drives a lead screw (43), whereby the carriage is driven along the guides. The rotor (12) may float on its shaft (13) and its position is sensed by detector (39, 40); the output of the detector is used to control motor (44) whereby the carriage is driven substantially continuously and smoothly at a rate appropriate for a counting operation being performed.

12 Claims, 4 Drawing Sheets

SHEET COUNTER HEAD CONTROL

Figure 1:
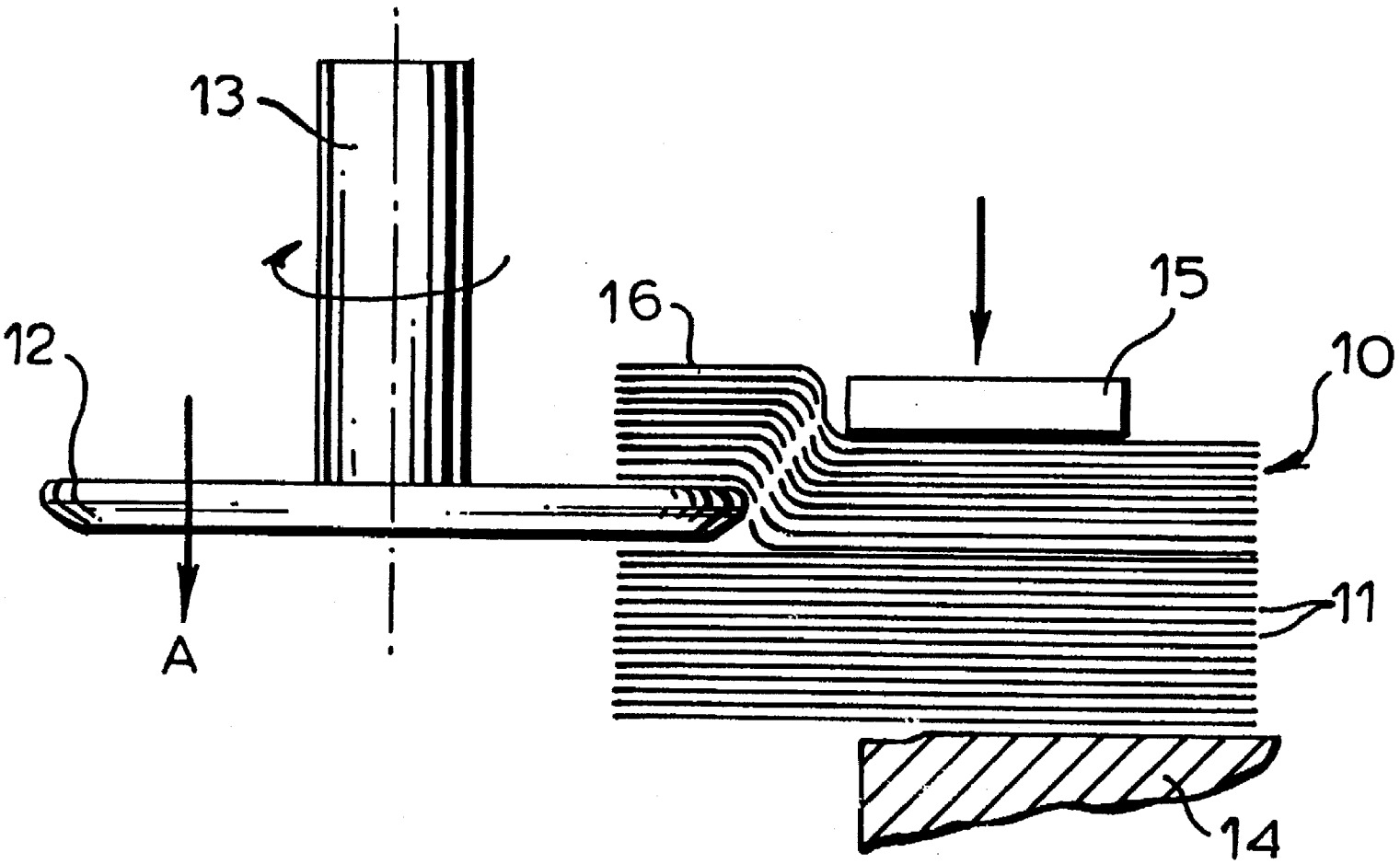

This invention concerns the counting of sheets, for example of paper, assembled into a stack. In particular, this invention relates to control means for a counting head to advance the head as counting progresses.

A known form of counting apparatus employs a rotor arranged to count the number of sheets in a stack by engaging an edge region of the stack and then, on rotation of the rotor, separating an edge portion of each sheet in turn from the stack and transferring the separated edge portion through a transfer groove to the other side of the rotor. At least one suction port may be provided in the rotor adjacent the transfer groove and through which port air is drawn in a timed relationship to rotor rotation, to assist the separation from the stack of the next sheet edge portion to be counted.

The sheets to be counted are assembled into a stack which is then located on a counting table, and clamped in position, ready to be counted. The edge regions—and usually a corner region—of the stack where counting takes place have to be able to separate to an extent sufficient to enable the rotor to be located between any two adjacent sheets in the stack. Thus, the stack must be clamped sufficiently far back from the region where counting takes place to permit this flexing.

As counting commences and sheet edge portions are transferred from one side of the rotor to the other, the rotor has to move along the height of the stack. In a known form of such counter, the rotor is mounted on a carriage arranged for vertical sliding movement along the height of the stack and which carriage is counter-balanced so that the rotor exerts, under gravity, a relatively small force on the stack. Then, the rotor may be allowed to move along the length of the stack merely by being pushed by the sheets of the stack, on these sheets being transferred from one side of the rotor to the other.

It is also known to mount the rotor for vertical movement on a carriage, there being two limit switches at the permitted extremes of rotor movement with respect to the carriage and a motor drive arrangement to move the carriage when the rotor triggers one limit switch, motor operation being suspended when the rotor triggers the other limit switch. Such motor control gives a varying engagement force between the rotor and the sheets being counted, and in turn this may lead to a lack of reliability in the counting operation.

According to the present invention, there is provided control means for a linearly-movable carriage supporting a counting head arranged to count each sheet in a stack of sheets, which counting head engages an edge region of the stack at one end thereof and then is advanced through the stack on transferring sheets, one at a time, to the other side of the head and generating a count on each said transfer, the counting head being movable with respect to the carriage generally in the direction of movement of the carriage, which control means comprises a motor to effect carriage movement, a linear sensor for the relative position of the counting head with respect to the carriage, and a control circuit for the motor and arranged to cause the motor to run at an appropriate speed having regard to the output of the sensor, whereby the carriage is advanced substantially constantly and at substantially the same rate as the counting head advances along the stack.

The control means of this aspect of the invention provides a linear control for the carriage supporting the counting head. In this way, the carriage may be advanced smoothly and more or less continuously as the counting head advances along the stack and in turn this assures that the force exerted by the counting head on each sheet of the stack, as each sheet is picked up for transfer across the head, is substantially constant.

The sensor employed in the control means of this invention may take any one of a variety of different forms. For example, a linear potentiometer may be employed, or a LVDT. Though a digital sensor, such as an optical encoder, could be employed, the sensor would have to have a relatively fine resolution and be associated with a digital-to-analogue converter so as to provide a linear signal for the control circuit.

The control means may include limit switches for carriage movement, to inhibit motor operation both when the carriage has been fully lifted away from a stack and when a counting operation has been completed. The control circuit may further include a control permitting selection of an appropriate advance rate for the counting head; this control may be used both to control motor speed and also to control counting head count rate.

Figure 2:
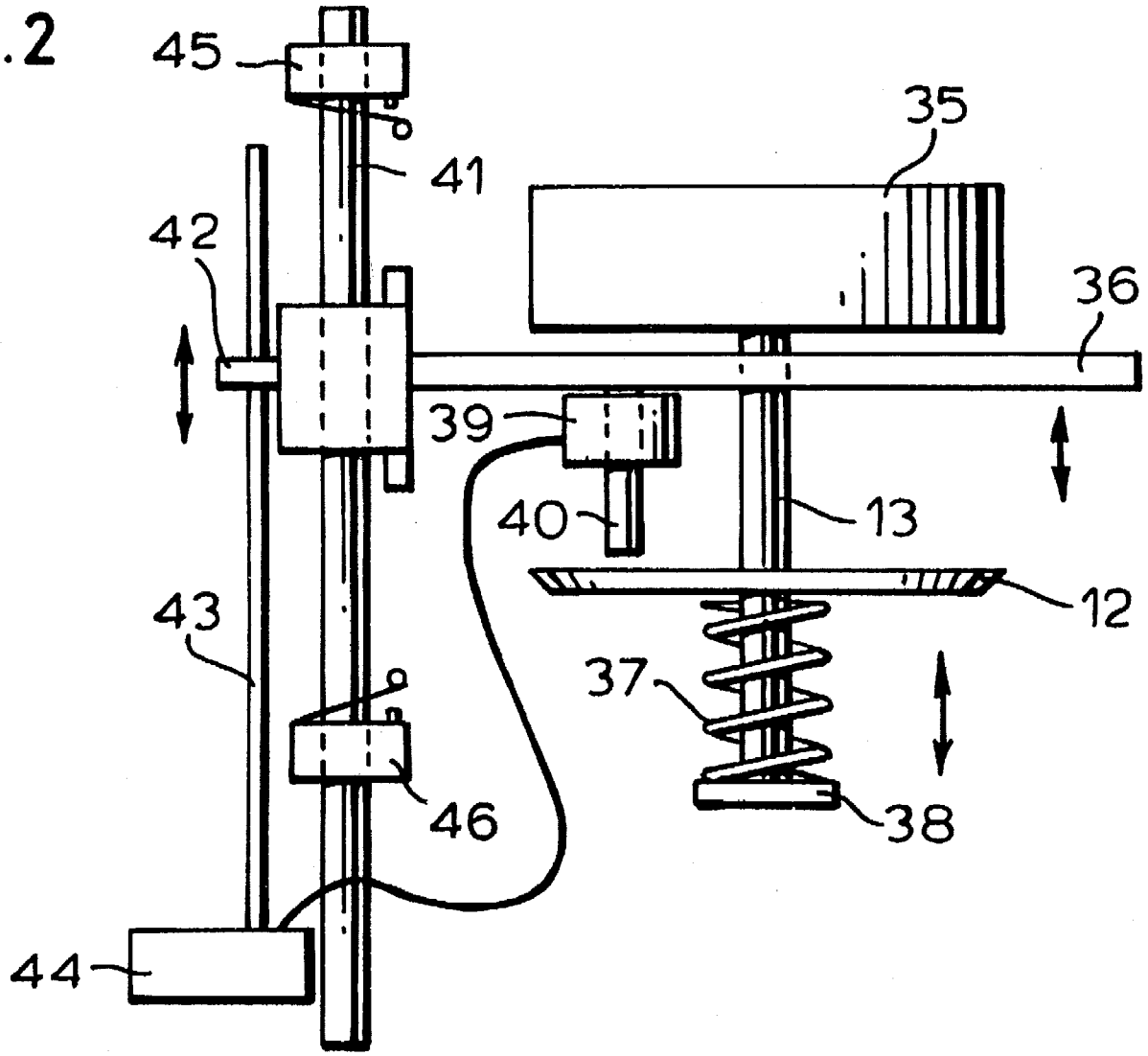
Figure 3:
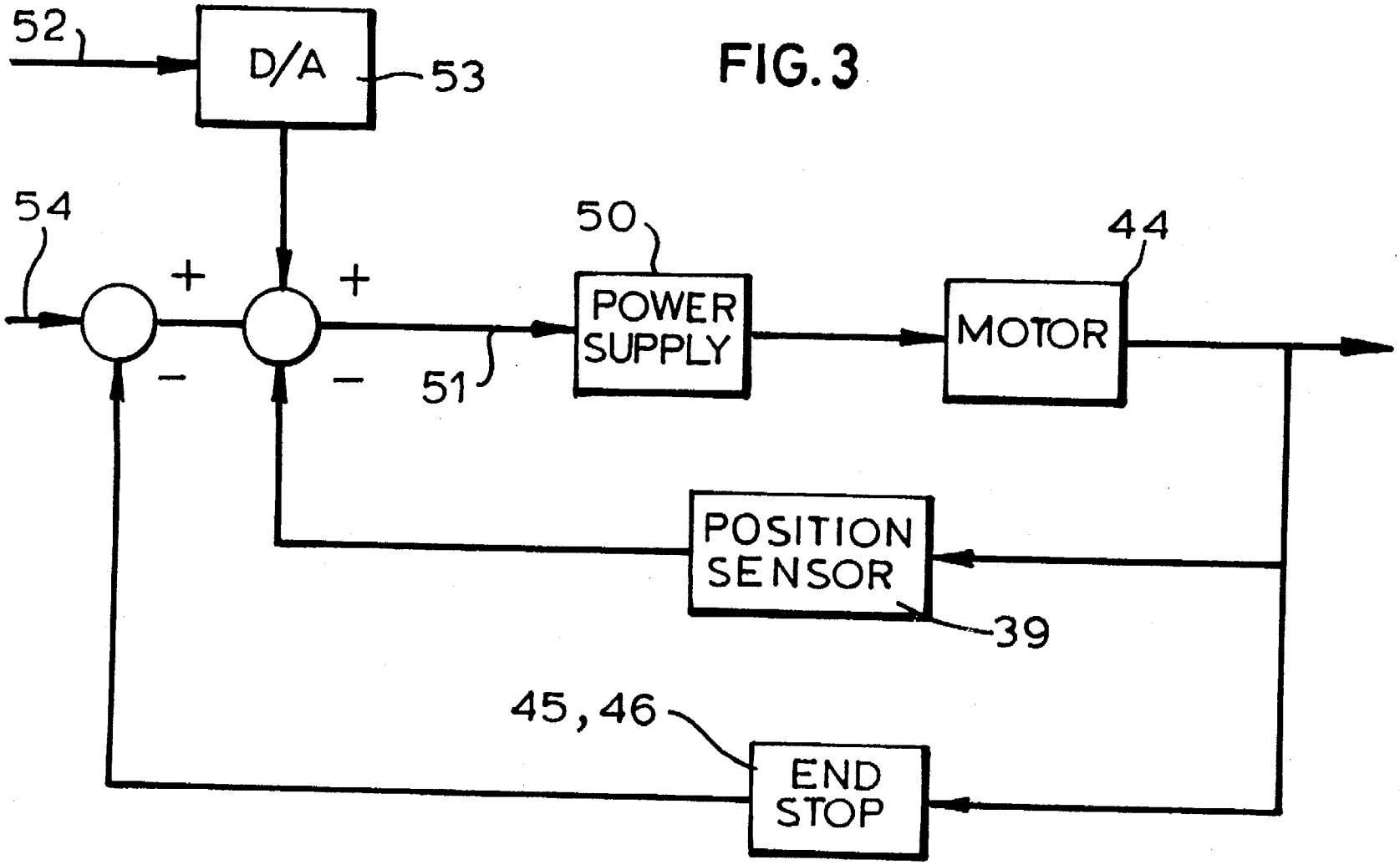
Figure 4:
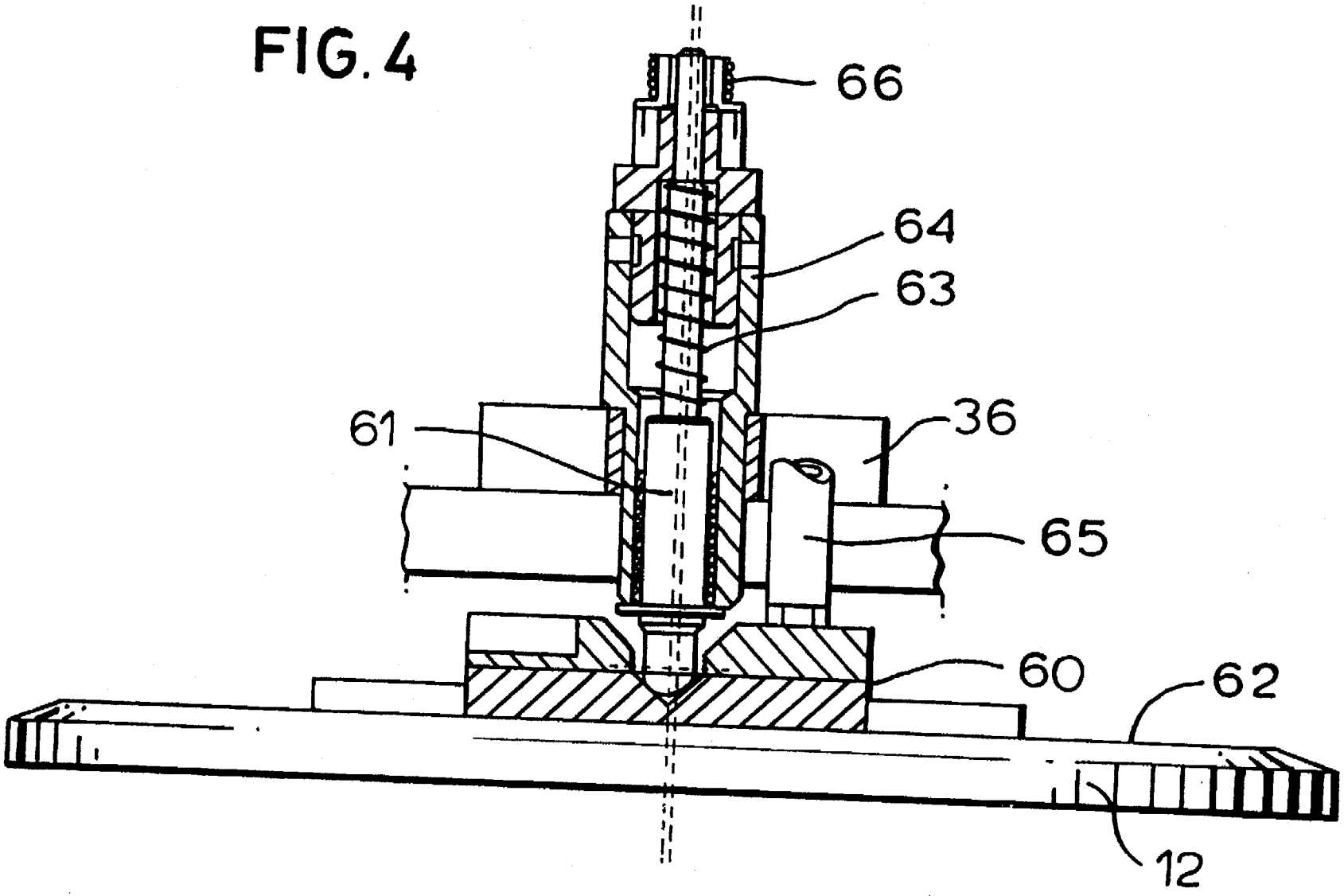

By way of example only, one specific embodiment of counting apparatus constructed and arranged in accordance with the present invention will now be described in detail, reference being made to the accompanying drawings, in which:

FIG. 1 diagrammatically illustrates the principle of a sheet counter with which the present invention is concerned;

FIG. 2 diagrammatically illustrates a counting rotor together with a carriage therefor, arranged for use with a control device in accordance with the present invention;

FIG. 3 diagrammatically illustrates the control circuit for the arrangement of FIG. 2; and FIG. 4 is a vertical part-sectional view on an alternative rotor position detection system.

FIG. 1 illustrates a part of a stack 10 of sheets 11 to be counted by means of a counting rotor 12 of a known construction, which rotor forms no part of the present invention and will therefore not be described in further detail here. The rotor may take the form of that counting rotor described in our co-pending International Patent Application filed in our name contemporaneously herewith, and claiming priority from 93GB-12614.2. The rotor 12 is mounted on a shaft 13 which is supported on a vertically-movable carriage (not shown) so that the rotor may be advanced in the direction of arrow A, along the height of the stack as counting progresses.

The sheets 11 in the stack 10 are clamped to a table 14 by means of a clamping pad 15 arranged to bear down on the top sheet 16 of the stack 10. Any suitable means for urging the pad 15 into engagement with the stack so as to exert a required pre-determined force on the stack may be employed. For example, the pad 15 may be mounted on and driven by a pneumatic ram, or on a lead screw driven by a motor, or by spring means.

In use, both the rotor 12 and the clamping pad 15 are lifted clear of the support table 14 so that a stack 10 of sheets may be assembled thereon. Both the rotor 12 and clamping pad 15 are then advanced to engage the top sheet of the stack, the pad being urged to engage the top sheet with a pre-determined clamping force. Rotation of the rotor 12 may then commence, to transfer sheets to the other side of the rotor, the rotor being advanced in the direction of arrow A, as counting progresses.

Control of vertical movement of the rotor is effected by the control arrangement illustrated in FIGS. 2 and 3. The rotor 12 is mounted by means of a non-rotatable linear bearing (not shown) on shaft 13 which is driven by a motor 35 mounted on a vertically-slidable carriage 36. A relatively light spring 37 acts between the rotor 12 and a flange 38 at the free end of the shaft 13, to urge the rotor 12 upwardly.

A second spring (not shown) may be disposed above the rotor 12, so that the rotor is balanced therebetween. A linear potentiometer 39, having a plunger 40, is mounted on the carriage 36 so that the plunger bears on and senses the position of the rotor 12, with respect to the carriage 36.

The carriage 36 is mounted on a pair of parallel guides 41 (only one of which is visible in FIG. 2) for vertical sliding movement. The carriage includes a nut 42 threaded on a lead screw 43 driven by a motor 44, whereby the vertical position of the carriage 36 may be adjusted as required, by driving the motor 44. Alternatively a motor and toothed-belt or other non-slip drive arrangement could be employed to effect movement of the carriage. Limit switches 45 and 46 for the carriage are provided at each end of the guides 41.

FIG. 3 is a block diagram of the control circuit for the arrangement illustrated in FIG. 2. A power supply 50 is arranged to drive motor 44 at a speed dependent upon input 51 to that power supply. The sensor 39 provides feedback to the input 51 of the power supply, whereby the speed at which the motor 44 is driven depends upon the sensed position of the rotor 12. The input 51 also is controlled by an external signal 52, for example derived from a key pad and converted to an analogue signal by D/A 53, for example to control the maximum and minimum speeds of operation of the motor 44. Limit switches 45 and 46 are arranged to inhibit motor operation in the same sense as triggered the respective limit switch, so that once triggered, the motor may be operated only in the reverse sense. A further control input 54 is provided to start and stop a counting operation.

Instead of the provision of a second spring, the rotor may be balanced between spring 37 and a spring force exerted by a sliding foot engaged with the upper side of the rotor, to permit the connection of a low-pressure source to passages in the rotor, to assist with the transfer of sheets from one side of the rotor to the other, during a counting operation. Such an arrangement is shown in FIG. 4.

A foot 60 is urged by a plunger 61 downwardly into engagement with the upper surface 62 of the rotor 12, by means of a spring 63 acting between a shoulder on the plunger 61 and a housing 64 mounted on the carriage 36. The plunger has a rounded lower end which is received in a conical recess in the foot 60, so that the foot may make good contact with the upper surface of the rotor and yet is accurately located by the plunger. A vacuum pipe 65 is connected to a low-pressure source and leads into passageways (not shown) in the foot, to communicate with further passageways in the rotor 12, as the rotor rotates.

At the upper end of the housing 64, there is a position detector 66 for the upper end of the plunger 61. This position detector provides an electrical output dependent upon the vertical position of the plunger, which output effectively comprises the signal of block 39 of the control circuit.

The control arrangement of FIGS. 2 and 3, and of FIGS. 3 and 4, ensures that the carriage 36 is advanced more or less continuously and smoothly as a counting operation proceeds. By providing sufficient gain in the control circuit, the carriage movement may accurately track the advancement of the rotor through the stack, so that a near-constant force is exerted between the rotor and the sheets of the stack.

I claim:

1. Control means for a linearly-movable carriage supporting a counting head arranged to count each sheet in a stack of sheets, which counting head engages an edge region of the stack at one end thereof and then is advanced through the stack to transfer sheets, one at a time, to the other side of the head and generating a count on each said transfer, the counting head being movable with respect to the carriage generally in the direction of movement of the carriage, which control means comprises a motor to effect carriage movement, a linear sensor for sensing the relative position of the counting head with respect to the carriage, and a control circuit for the motor and arranged to cause the motor to run at an appropriate speed in response to an output of the sensor, whereby the carriage is advanced substantially constantly and at substantially the same rate as the counting head advances along the stack.

2. Control means as claimed in claim 1, wherein the sensor is selected from the group consisting of a linear potentiometer and a LVDT.

3. Control means as claimed in claim 1, wherein the control means includes limit switches for carriage movement, to inhibit motor operation both when the carriage has been fully lifted away from a stack and when a counting operation has been completed.

4. Control means as claimed in claim 1, wherein the control circuit further includes a control permitting selection of an appropriate advance rate for the counting head.

5. Control means as claimed in claim 1, wherein the carriage is slidably mounted on at least one guide therefor, the guide extending substantially parallel to the edge of a stack of sheets to be counted.

6. Control means as claimed in claim 1, wherein the counting head includes a rotor arranged to engage in the edge region of the stack of sheets, and to transfer the sheets one at a time from one side of the rotor to the other side thereof upon rotation of the rotor.

7. Control means as claimed in claim 6, wherein the rotor is mounted on a shaft supported by the carriage, the shaft being drivingly connected to the rotor but the rotor being movable axially with respect to the shaft.

8. Control means as claimed in claim 7, wherein the rotor is mounted on the shaft by a non-rotatable linear bearing.

9. Control means as claimed in claim 7, wherein the rotor shaft extends substantially vertically and the rotor is supported on that shaft by a spring.

10. Control means as claimed in claim 9, wherein means are provided to provide a downward bias to the rotor.

11. Control means as claimed in claim 10, wherein the downward bias is provided by a foot assembly bearing on the rotor and arranged to couple a low-pressure source to the rotor.

12. Control means for a sheet counter comprising a carriage;

at least one linear guide on which the carriage is mounted for linear sliding movement;

a counting rotor mounted on the carriage for movement with respect thereto generally in the direction of sliding movement of the carriage, the rotor having first and second sides and arranged to engage an edge region of a stack of sheets to be counted, the rotor being configured to transfer sheets one at a time from the first side of the rotor to the second side thereof upon rotation of the rotor and a count signal being generated on each such transfer;

a motor to effect linear sliding movement of the carriage;

a linear sensor to sense the position of the rotor relative to the carriage; and a control circuit for the motor and arranged to cause the motor to run at an appropriate speed in response to an output of the sensor, whereby the carriage is advanced substantially constantly and at substantially the same rate as the rotor advances along the stack during the rotation of the rotor.

* * * * *